United States Patent [19]

Dzurko et al.

[11] Patent Number: 4,989,313

[45] Date of Patent: Feb. 5, 1991

[54] MAGNETIC ALIGNMENT FIXTURE

[75] Inventors: Thomas A. Dzurko, Mt. Clemens; Anthony Foster, Southfield; Eugene W. Lang, Mt. Clemens, all of Mich.

[73] Assignee: General Motors Corporation, Detroit, Mich.

[21] Appl. No.: 458,272

[22] Filed: Dec. 28, 1989

[51] Int. Cl.[5] ..... B25B 11/00

[52] U.S. Cl. ..... 29/281.4; 29/281.5; 269/8; 269/904; 33/DIG. 1

[58] Field of Search ..... 269/8, 276, 904, 286, 269/287, 37, 40; 29/281.1, 281.4, 281.5; 33/DIG. 1; 408/291 G, 115 R, 72 R

[56] References Cited

U.S. PATENT DOCUMENTS

| | | | |
|---|---|---|---|
| 2,153,080 | 4/1939 | Flora . | |
| 2,383,008 | 8/1945 | Meister . | |
| 2,606,470 | 8/1952 | Kinney | 269/276 |
| 2,666,352 | 1/1954 | Philips | 269/276 |
| 2,681,245 | 6/1954 | Ackermans . | |
| 2,792,634 | 5/1957 | Howe et al. . | |
| 3,416,235 | 12/1968 | Spilker | 33/DIG. 1 |
| 3,418,018 | 12/1968 | Marburger et al. . | |
| 3,436,070 | 4/1969 | Utley et al. | 33/DIG. 1 |
| 3,944,194 | 3/1976 | Robinson | 269/8 |
| 4,291,467 | 9/1981 | Shultz | 33/DIG. 1 |
| 4,300,759 | 11/1981 | Lawrence | 269/8 |
| 4,538,354 | 9/1985 | Smolik . | |
| 4,569,511 | 2/1986 | Bell | 269/276 |

FOREIGN PATENT DOCUMENTS

| | | | |
|---|---|---|---|
| 1313223 | 4/1973 | United Kingdom | 269/276 |

*Primary Examiner*—Robert C. Watson
*Attorney, Agent, or Firm*—Charles E. Leahy

[57] ABSTRACT

A magnetic alignment fixture to temporarily hold a door latch striker in position relative to a door jamb while the alignment of the doors is adjusted. The magnetic alignment fixture includes a base plate of flexible material having an aperture for receiving and positioning the striker. The base plate magnetically holds the striker on the door jamb. The base plate may be moved by sufficient force applied against the striker in the plane parallel to the door jamb to overcome the magnetic force holding the base plate and thereby adjusts the position of the striker. The flexibility of the base plate allows the base plate to be flexibly peeled away from the door jam and the striker in a direction perpendicular to the door jamb after the striker is secured to the door jamb.

3 Claims, 3 Drawing Sheets

MAGNETIC ALIGNMENT FIXTURE

The invention relates to a fixture for assisting in aligning doors on motor vehicles and more particularly provides a magnetic alignment fixture for temporarily holding the striker in position in relation to the door jamb.

BACKGROUND OF THE INVENTION

The door on a motor vehicle is mounted in a door opening by a pair of hinges. The door has a latch which engages with a striker mounted on the door jamb. As the latch engages the striker, the door is positioned both transversely and vertically to align the door in the door opening.

It is therefore desirable during motor vehicle assembly to properly position the striker on the pillar or door jamb of the vehicle so that the door aligns properly in the closed position.

In one method, the striker is installed by hand tightening the striker to the door jamb of the vehicle. The vehicle door is then closed with the striker being accepted by the door latch. The vehicle door is adjusted to align the outer panel of the door with the face of the adjacent panel. The vehicle door is then opened and the striker is tightened in the position that it is found after the door is open.

The striker, however, has a tendency to move as the door is being unlatched, since the striker is not firmly secured to the door jamb. This results in the striker requiring trial and error readjustment.

A second method currently being used is to tighten the striker all the way. The door is closed and visually inspected to determine which direction the striker needs to move. The door is opened and a tool is used to bend the striker in the right direction in relation to the door jamb. This operation is repeated until the proper position is achieved by trial and error.

It would be desirable to provide a device for aligning the striker and then holding the striker in the proper position until the striker can be tightened into position without requiring a trial and error method.

SUMMARY OF THE INVENTION

This invention provides a magnetic alignment fixture for temporarily holding a striker in a position relative to a door jamb. The magnetic alignment fixture includes a base plate of flexible material having an aperture for receiving and positioning the striker in the plane parallel to the base plate. The base plate is held magnetically to the door jamb with the base plate parallel to the jamb, thereby positioning the base plate on the door jamb and restricting motion of the striker in the plane of the surface of the door jamb. The base plate may be moved by sufficient force applied against the striker in the plane parallel to the door jamb to overcome the magnetic force holding the base plate. The position of the striker may therefore be adjusted to a desired position. The flexibility of the base plate allows the base plate to be flexibly peeled away from the door jam and the striker in a direction perpendicular to the door jamb after the striker is secured to the door jamb.

One object, feature and advantage of the invention resides in the provision of a magnetic alignment fixture of flexible material which has an aperture to hold a striker to the door jamb and can be flexibly peeled away from the door jamb.

Another object, feature and advantage of the invention is an improved means for holding a striker in position relative to the door jamb while aligning and securing the striker.

Further objects features and advantages of the present invention will become more apparent to those skilled in the art as the nature of the invention is better understood from the accompanying drawings and detailed description.

DESCRIPTION OF THE PREFERRED EMBODIMENT

Figure 1:
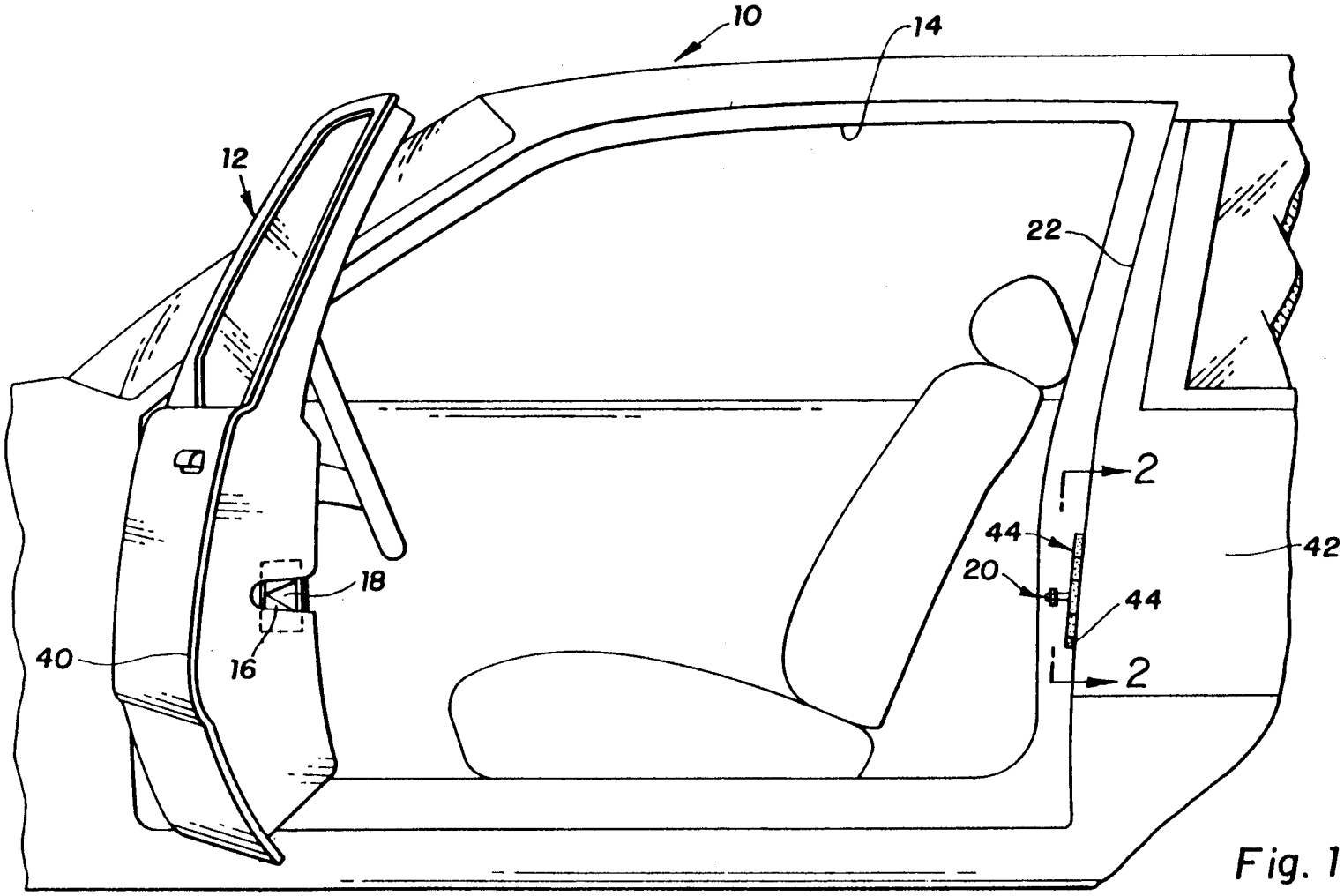
FIG. 1 is a partial side elevation view of a motor vehicle showing door and a magnetic alignment fixture according , invention supporting the striker.

A motor vehicle 10 has a door 12 that is mounted in a door opening 14 of the vehicle 10 by a pair of hinges, not shown. A latch 16 mounted on the door 12 has a "V" shaped opening 18 for accepting a striker 20 which is mounted on a pillar or door jamb 22, as shown in FIG. 1.

Figure 2:
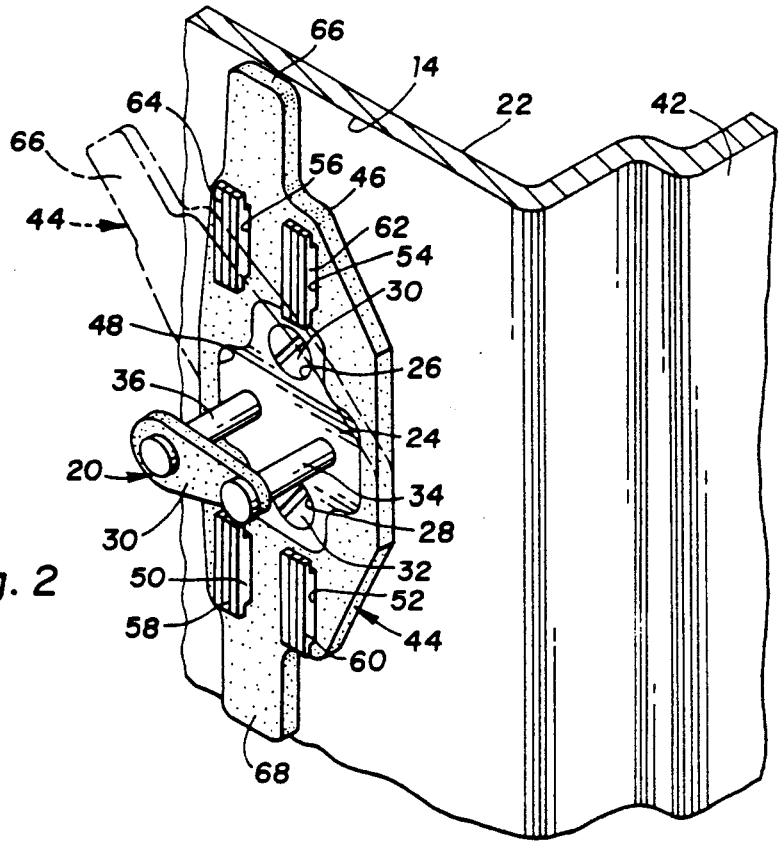
FIG. 2 is a fragmentary perspective view taken in the direction of arrows 2-2 of FIG. 1 showing the magnetic alignment fixture positioning the striker on the door jamb, and in phatom the magnetic alignment fixture being peeled away from the door jamb.

The striker 20, as shown in FIG. 2, has a mounting plate 24 with a pair of holes 26 and 28 for receiving two bolts 30 and 32. The striker 20 has a leading leg 34 and a trailing leg 36 which project out from the mounting plate 24 and mount a plastic wedge 38. The striker 20 is mounted to the door jamb 22 by the two bolts 30 and 32, which extend through oversize holes in the door jamb and are received in threaded holes in a tapped cage plate, not shown, located inside the door jamb 22. The tapped cage plate is confined in a metal cage, which allows the tapped cage plate to slide around several millimeters in both the transverse and vertical directions. When the bolts 30 and 32 are tightened the striker 20 is held stationary with respect to the door jamb 22 by sandwiching the door jamb 22 between the mounting plate 24 and the tapped cage plate.

Figure 3:
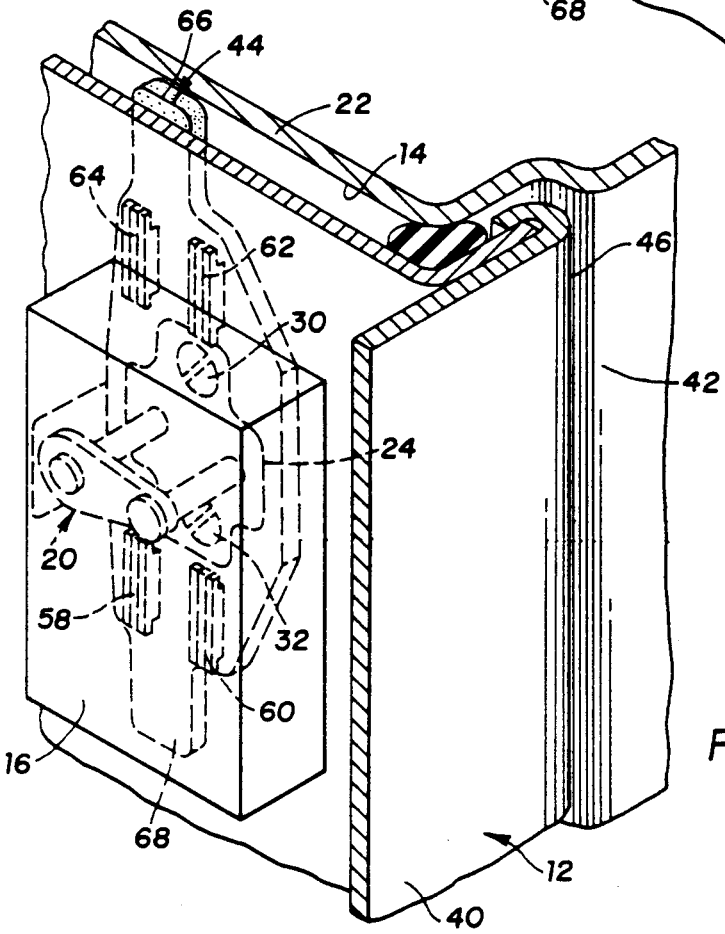
FIG. 3 is a section view similar to FIG. 2 but with the door in the closed position and the striker received by the door latch.

When the door 12 is closed, as shown in FIG. 3, the leading leg 34, the trailing leg 36 and the plastic wedge 38 are received by the latch 16. The latch 16 has a fork bolt which engages with the leading leg 34 to connect the latch 16 with the striker 20, thereby latching the door in the closed position. In this latched condition, the plastic wedge 38 fits snugly within the 'V' shaped opening 18 of the door latch 16 and is captured therein by the latching action of the fork bolt. The latch remains in this position until the latch is released. Reference may be had to U.S. Pat. No. 4,756,563 to Garwood et al. for a more desired description of this wedge-style door latch and striker Referring to FIG. 3, the position of the striker 20 determines the alignment of the door 12 in the door opening 14, because the snug fitting capture of the plastic wedge 38 in the 'V' shape opening 18 establishes both the transverse and vertical location of the trailing end of the door within the door opening 14. Therefore a change in the position of the striker 20 in the vertical and transverse directions on the door jamb will adjust the closed position of the door 12. The door 12 is in the proper position in the transverse direction when the outer panel 40 of the door 12 is flush with the face of an adjacent panel 42 of the vehicle 10. The door 12 is in the proper position in the vertical direction when the door 12 is centered in the door opening 14. The several millimeters of movement of the tapped cage plate and the striker allows the striker 20 to be adjusted to obtain the proper alignment of the door 12.

Figure 4:
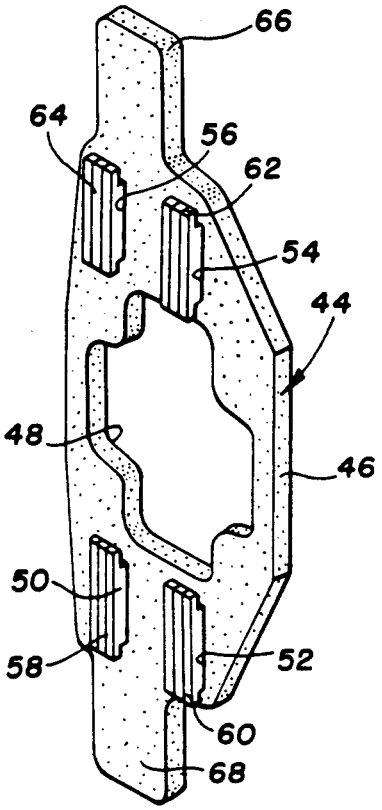
FIG. 4 is a perspective view of the magnetic alignment fixture.

A magnetic alignment fixture 44, best seen in FIG. 4, has a base 46 of flexible material such as rubber. The base 46 has an aperture 48 to accept and hold the mounting plate 24 of the striker 20. The magnetic alignment fixture 44 has four slots 50, 52, 54 and 56 in the base 46 in which four magnets 58, 60, 62, and 64 are mounted. The magnets 58, 60, 62 and 64 hold the magnetic alignment fixture 44 to the door jamb 22. The magnetic alignment fixture 44 has a pair of handles 66 and 68 which are extensions of the base 46 and exist in the same plane.

The magnetic alignment fixture 44 is used to properly align the door 12. The striker 20 is attached to the door jamb 22 by installing and hand tightening the bolts 30 and 32. Alternatively the bolts 30 and 32 can be tightened and then loosened slightly so that the striker 20 may be adjusted both transversely and vertically in relation to the door jamb. The magnetic alignment fixture 44 is placed on the door jamb 22 with the aperture 48 receiving the mounting plate 24 of the striker 20. The aperture 48 snugly receives the striker 20 and retains the striker 20 in the transverse and vertical directions in relation to the door jamb 22 prior to the bolts 30 and 32 being tightened in the tapped cage plate. With the magnetic alignment fixture 44 retaining the striker 20, the striker 20 is moved transversely outward and vertically up in relation to the door jamb 22. This pre-positioning of the striker 20 ensures that the door latch 16 will engage the striker 20 as the door 12 is closed.

The door 12 is then closed as shown in FIG. 3 with the "V" shaped opening 18 of the latch 16 moving the striker 20. Next, the outer panel 40 of the door 12 is aligned with the face of the adjacent panel 42 of the vehicle 10 by moving the door 12 by use of the door handle or the window opening to maneuver the door both transversely and vertically to obtain the desired alignment of the door 12. The magnets 58, 60, 62 and 64 allow the moving and maneuvering of the magnet alignment fixture 44 as the striker 20 is adjusted into the proper position. The door 12 is then opened by lifting the door handle to release the door latch 16 from the striker 20. The magnets 58, 60, 62 and 64 hold the striker 20 in the adjusted position. The magnetic alignment fixture 44 is designed so that the magnetic force created by the magnets 58, 60, 62 and 64 is strong enough to maintain the adjusted position of the mounting plate 24 of the striker 20 when the door 12 is unlatched irrespective of the magnitude of the force which may be exerted on the striker 20 by the door latch 16 as the latch 16 backs out of the striker 20. The bolts 30 and 32 are the tightened to permanently hold the striker at the adjusted position providing door 12 alignment within the door opening 14.

The magnetic alignment fixture 44 can be peeled away from the door jamb 22 as shown by the phantom lines in FIG. 2 because the base 46 of the magnetic alignment fixture 44 is made of a flexible material. The door 12 is then closed again to check the alignment with respect to the vehicle 10. The same procedure may be repeated to re-adjust the door 12 on the vehicle 10, if the door 12 needs to be re-aligned.

Figure 5:
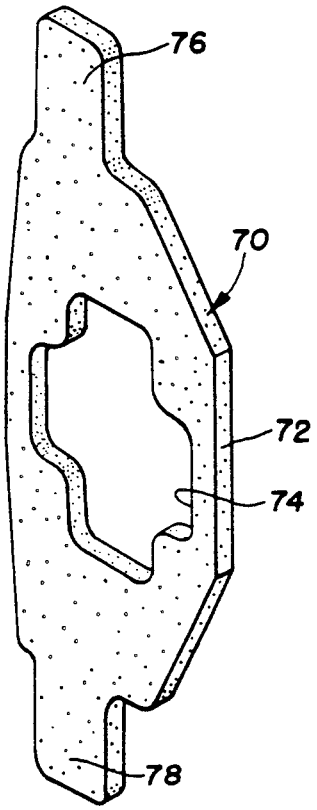
FIG. 5 is a perspective view of a second embodiment of the alignment fixture.

A second embodiment of the invention, shown in FIG. 5, has a magnetic alignment fixture 70 made of a base 72 of flexible material with magnetic particles dispersed throughout the rubber base 72 to hold the magnetic alignment fixture 70 to the door jamb 22. The magnetic alignment fixture 70 has an aperture 74 to accept and hold the striker 20 and a pair of handles 76 and 78 similar to the first embodiment for peelably removing the magnetic alignment fixture from the door jamb 22. The magnetic alignment fixture 70 is used in the same way as the magnetic alignment fixture 44 of the first embodiment.

Figure 6:
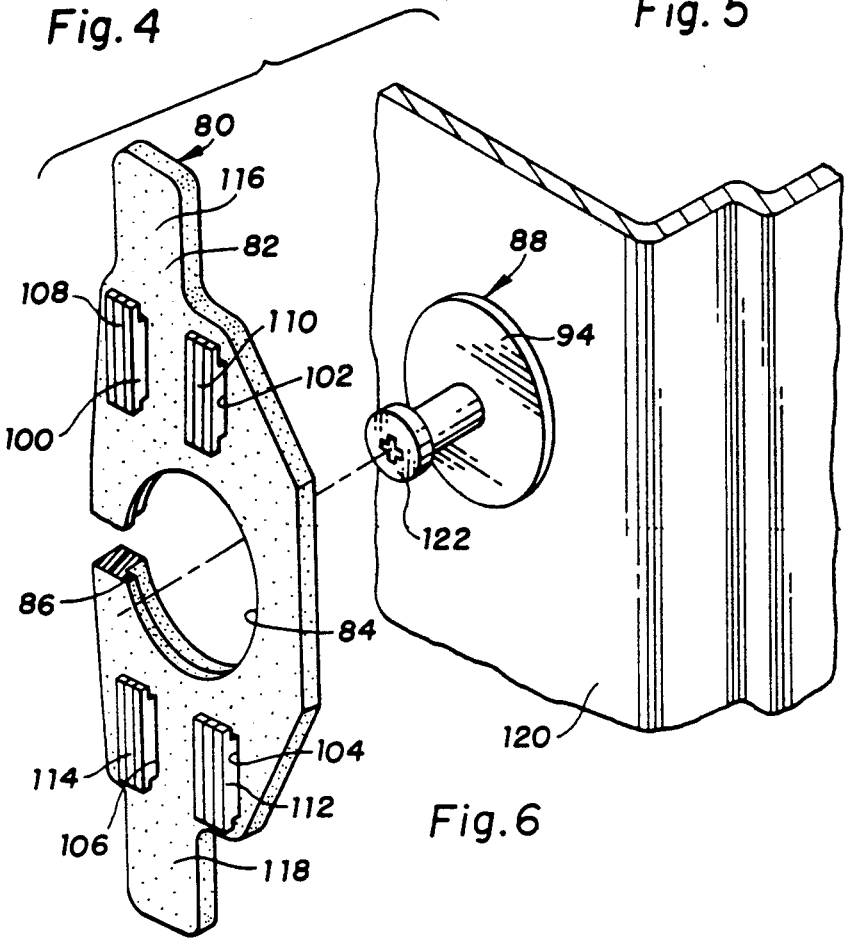
FIG. 6 is a perspective view of a third embodiment of the magnetic alignment fixture and a single post striker positioned on the door jamb.

A third embodiment of the invention, shown in FIG. 6, has a magnetic alignment fixture 80 made of a flexible base 82. A striker 88 is of a different style from that shown in the first two embodiments and is comprised of a single post 122 projecting from a circular mounting plate 94. A portion of post 122 projects from the back of the circular mounting plate 94 and is threaded to be received by the tapped cage plate. Accordingly the base 82 has a circular aperture 84 to accept and hold the circular mounting plate 94 of the striker 88. The magnetic alignment fixture 80 has a lip 86 around the aperture 84 to overlay the mounting plate 94 and thereby retain the striker 88 even before the striker 88 is hand tightened into the tapped cage plate. The magnetic alignment fixture 80 has four slots 100, 102, 104, and 106 in the base 82 in which four magnets 108, 110, 112, and 114 are mounted. The magnetic alignment fixture 80 has a pair of handles 116 and 118 for peelably removing the magnetic alignment fixture 80 from the door jamb. The magnetic alignment fixture 80 works the same way in relation to the a door jamb 120 as the first embodiment.

Thus, the magnetic alignment fixture provides a means of allowing alignment of the striker and holding the striker in the proper position until the striker can be tightened into position properly aligning the door. The aperture in the base can be shaped to fit different styles of strikers and the magnetic force is determined to suit the particular style of latch and striker.

While three embodiments of the present invention have been explained, various modifications within the spirit and scope of the following claims will be readily apparent to those skilled in the art.

The embodiments of the invention in which an exclusive property or privilege is claimed are defined as follows:

1. A magnetic alignment fixture for temporarily holding a striker in a position relative to a door jamb, the magnetic alignment fixture comprising:

a base plate of flexible material having an aperture sized to snugly receive the striker and positioning the striker in the plane parallel to the base plate; and magnet means holding the base plate to the door jamb with the base plate parallel to the door jamb thereby positioning the striker on the door jamb and restricting motion of the striker in the plane of the surface of the door jamb, and the magnet means allowing the base plate to move with the striker when sufficient force is applied against the striker in the plane parallel to the door jamb to overcome the magnet means holding the base plate so that the base plate is moved by the striker whereby the position of the striker may be adjusted to a desired position where the magnetic alignment fixture holds the striker, and the magnet means further allowing the base plate to be flexibly peeled away from the door jamb and the striker in a direction perpendicular to the door jamb after the striker is secured in the desired position.

2. A magnetic alignment fixture for temporarily holding a striker in a position relative to a door jamb, the magnetic alignment fixture comprising:

a base plate of flexible material having an aperture sized to snugly receive the striker and positioning the striker; and a plurality of magnets embedded in the base plate for holding the base plate to the door jamb thereby positioning the striker on the door jamb and restricting motion of the striker in the plane of the surface of the door jamb, and the plurality of magnets allowing the base plate to move with the striker when sufficient force is applied against the striker in the plane parallel to the door jamb to overcome the plurality of magnets holding the base plate so that the base plate is moved by the striker whereby the position of the striker may be adjusted to a desired position where the magnetic alignment fixture holds the striker, and the plurality of magnets further allowing the base plate to be flexibly peeled away from the door jamb and the striker in a direction perpendicular to the door jamb after the striker is secured in the desired position.

3. A magnetic alignment fixture for temporarily holding a striker in a position relative to a door jamb, the magnetic alignment fixture comprising:

a sheet of flexible magnetic rubber magnetically attachable to the door jamb and having an aperture sized to snugly receive the striker and positioning the striker, to thereby position the striker on the door jamb and restrict motion of the striker in the plane of the surface of the door jamb, and the sheet of flexible magnetic rubber allowing the sheet of flexible magnetic rubber to move with the striker along the door jamb when sufficient force is applied in the plane parallel to the door jamb to overcome magnetic attachment of the flexible magnetic rubber so that the sheet of flexible magnetic rubber is moved by the striker thereby the position of the striker may be adjusted to a desired position where the magnetic alignment fixture holds the striker and the flexible magnetic rubber further being flexibly peeled away from the door jam and the striker in a direction perpendicular to the door jamb subsequent to the attachment of the striker on the door jamb.

* * * * *